US009963941B2

(12) United States Patent
Scott et al.

(10) Patent No.: US 9,963,941 B2
(45) Date of Patent: May 8, 2018

(54) METHODS OF FORMING CUTTING ELEMENTS AND EARTH-BORING TOOLS CARRYING SUCH CUTTING ELEMENTS

(71) Applicant: Baker Hughes Incorporated, Houston, TX (US)

(72) Inventors: Danny E. Scott, Montgomery, TX (US); Konrad Thomas Izbinski, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 291 days.

(21) Appl. No.: 14/746,491

(22) Filed: Jun. 22, 2015

(65) Prior Publication Data

US 2016/0369567 A1 Dec. 22, 2016

(51) Int. Cl.

| | |
|---|---|
| ***E21B 10/567*** | (2006.01) |
| ***B24D 18/00*** | (2006.01) |
| ***B24D 99/00*** | (2010.01) |

(52) U.S. Cl.

CPC ..... *E21B 10/567* (2013.01); *B24D 18/0009* (2013.01); *B24D 99/005* (2013.01)

(58) Field of Classification Search

CPC .. E21B 10/567; B24D 99/005; B24D 18/0009

See application file for complete search history.

(56) References Cited

U.S. PATENT DOCUMENTS

| | | | | |
|---|---|---|---|---|
| 8,074,566 | B1 | 12/2011 | Bach | |
| 2008/0142276 | A1* | 6/2008 | Griffo | E21B 10/5735 175/432 |
| 2013/0306377 | A1 | 11/2013 | DiGiovanni et al. | |

* cited by examiner

*Primary Examiner* — Pegah Parvini

(74) *Attorney, Agent, or Firm* — TraskBritt

(57) ABSTRACT

A method of forming a cutting element for an earth-boring tool includes forming a table of superabrasive material over a substrate in an HTHP environment such that the table of superabrasive material is bonded to the substrate. The table of superabrasive material and the substrate form a cutting element. The method includes removing the cutting element from the HTHP environment, ascertaining predictable residual stresses within the table of superabrasive material, and marking the cutting element with at least one mark. The at least one mark provides indication of a region of the table of superabrasive material having a maximum or minimum residual stress therein. An additional method includes obtaining such a marked cutting element and affixing the cutting element on an earth-boring tool in a preferential orientation as indicated at least partially by the mark.

20 Claims, 10 Drawing Sheets

METHODS OF FORMING CUTTING ELEMENTS AND EARTH-BORING TOOLS CARRYING SUCH CUTTING ELEMENTS

FIELD

The present disclosure relates generally to methods of forming cutting elements, methods of marking cutting elements, and methods of forming earth-boring tools carrying marked cutting elements. Specifically, embodiments of the present disclosure relate to methods of forming cutting elements having tables of superabrasive material bonded to a substrate, methods of marking the cutting elements in a manner indicating predictable residual stresses within the superabrasive tables, methods of orienting marked cutting elements during attachment to earth-boring tools, and related structures.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. The cutting elements used in such earth-boring tools often include polycrystalline diamond compact (often referred to as "PDC") cutting elements, which include a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit," under conditions of high temperature and high pressure in the presence of a catalyst, such as, for example, cobalt, iron, nickel, or alloys and mixtures thereof, to form a layer of polycrystalline diamond material, also called a diamond table or a superabrasive table. These processes are often referred to as high-temperature/high-pressure ("HTHP") processes. The cutting element substrate may comprise a cermet material, i.e., a ceramic-metal composite material, such as, for example, cobalt-cemented tungsten carbide. In some instances, the polycrystalline diamond table may be bonded to the substrate, for example, during the HTHP sintering process.

Polycrystalline diamond possesses a coefficient of thermal expansion lower than that of the previously mentioned substrate materials. When the superabrasive table is bonded to the substrate to form a consolidated cutting element during the HTHP process, such as created in a cubic press or a belt press, the substrate subsequently contracts to a greater extent than the superabrasive table as the cutting element is allowed to cool. This difference in the contraction between the substrate and the superabrasive table creates residual stresses in both the superabrasive table and the substrate.

BRIEF SUMMARY

In some embodiments, a method of forming a cutting element for an earth-boring tool comprises forming a table of superabrasive material over a substrate in an HTHP environment such that the superabrasive material is bonded to the substrate, the table of superabrasive material and the substrate forming a cutting element. The method includes removing the cutting element from the HTHP environment, ascertaining predictable residual stresses within the table of superabrasive material, and marking the cutting element with at least one mark. The at least one mark provides indication of a region of the table of superabrasive material having a maximum or minimum residual stress therein.

In other embodiments, a method of forming an earth-boring tool comprises obtaining a formed cutting element carrying at least one mark. The at least one mark is configured to allow the cutting element to be oriented on the earth-boring tool in a primary orientation. At the primary orientation, residual stresses within the table of superabrasive material are substantially preferentially unaligned with anticipated service load stresses during use in an earth-boring operation. The method includes positioning the cutting element in the primary orientation relative to the face of the earth-boring tool, and affixing the cutting element to the face of the earth-boring tool in the primary orientation.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings.

DETAILED DESCRIPTION

The illustrations presented herein are not meant to be actual views of any particular earth boring tool, bit, cutting element or component thereof, but are merely idealized representations employed to describe illustrative embodiments. Thus, the drawings are not necessarily to scale.

As used herein, the term "longitudinal" refers to a direction parallel to a longitudinal axis of a cutting element.

As used herein, the term "transverse" refers to a direction orthogonal to the longitudinal axis of the cutting element.

Cutting elements for earth-boring tools possess various residual stresses resulting from of a number of different parameters, including the size, geometry and physical composition of the cutting element and its various components, as well as the environment in which the cutting element was formed. In cutting elements having a superabrasive table configured to engage uncut subterranean earth formation material, residual stresses within the superabrasive table may be of particular concern, as the superabrasive table primarily contacts the uncut subterranean earth formation material and bears the majority of service load forces, such as impact forces, exerted by the formation material. Failure of the superabrasive table may effectively result in failure of the cutting element as a whole.

The present disclosure includes embodiments of methods for forming a cutting element that may be axially oriented on an earth-boring tool in a manner to unalign undesirable residual stresses within the superabrasive table with anticipated service loads. The embodiments include methods of ascertaining predictable residual stresses within a superabrasive table. Once the predictable residual stresses are ascertained, a reference mark may be applied to the cutting element at a circumferential location thereof indicating a peripheral region of the superabrasive table having a maximum or minimum residual stress therein, as described in embodiments herein. The present embodiments also include methods of orienting the cutting element on an earth-boring tool such that the peripheral region having the maximum or minimum residual stress is configured to contact uncut subterranean earth formation material.

Figure 1:
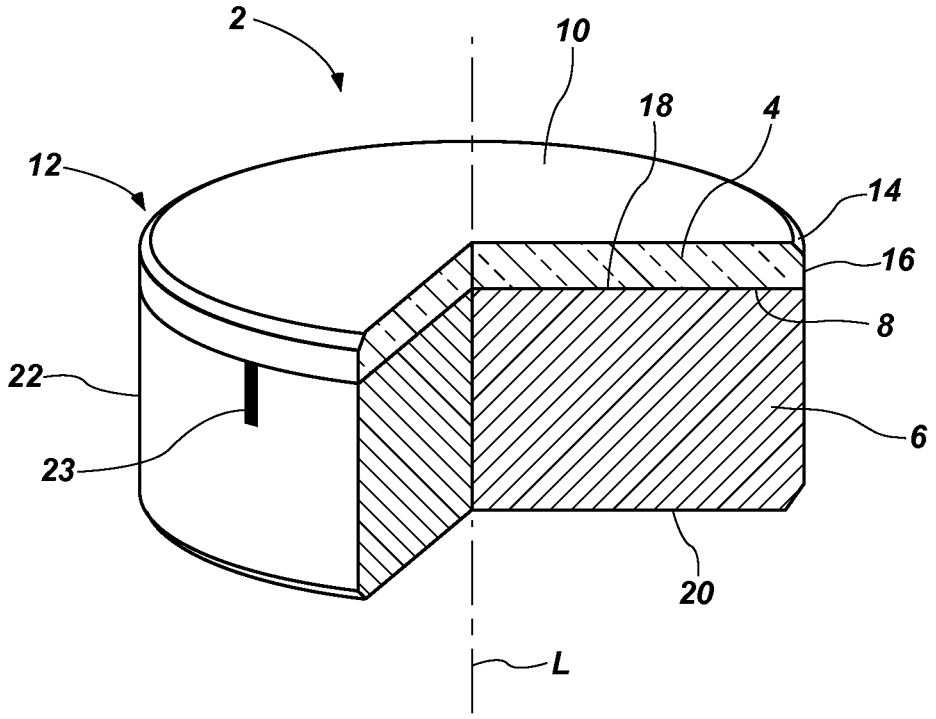
FIG. 1 illustrates a simplified perspective view of a cutting element showing a cutaway portion, according to an embodiment of the present disclosure.

Referring to FIG. 1, a partially cut-away perspective view of a cutting element 2 is shown. The cutting element 2 may include a volume of superabrasive material 4 disposed on a substrate 6. The volume of superabrasive material 4 may comprise, for example, synthetic diamond, natural diamond, a combination of synthetic diamond and natural diamond, polycrystalline diamond (PCD), cubic boron nitride, polycrystalline cubic boron nitride, carbon nitrides, or other superabrasive materials known in the art. The volume of superabrasive material 4 may be termed a "superabrasive table," although, when the superabrasive table 4 comprises polycrystalline diamond, the superabrasive table 4 is often referred to in the art as a "diamond table."

The superabrasive table 4 may be formed on the substrate 6, or the superabrasive table 4 and the substrate 6 may be separately formed and subsequently attached together at an interface 8. The superabrasive table 4 may have a cutting face 10 located opposite the interface 8 and extending generally transverse to a longitudinal axis L of the cutting element 2. An outer peripheral edge of the cutting face 10 (as the cutting element 2 is mounted to a body of an earth boring tool) may be defined as a cutting edge 12 by which the cutting element 2 engages and cuts subterranean earth formation material. The superabrasive table 4 may have a single chamfer surface 14 extending radially inward from the cutting edge 12, as shown in FIG. 1, or may have multiple chamfer surfaces and/or a rounded peripheral edge (not shown). The superabrasive table 4 may have a side surface 16 extending longitudinally from the cutting edge 12 to the interface 8 between the superabrasive table 4 and the substrate 6.

The substrate 6 may have a generally cylindrical shape and a first end surface 18, also termed an "interface surface," located adjacent the superabrasive table 4 and a second end surface 20, also termed a "base surface," located opposite the interface 8. The substrate 6 may also include a generally cylindrical lateral side surface 22 extending between the interface surface 18 and the base surface 20. A reference mark 23 may be included on a lateral side surface 16, 22 of the cutting element 2, as described in more detail below.

The substrate 6 may be formed from a material that is relatively hard and resistant to wear. For example, the substrate 6 may be formed from and include a ceramic-metal composite material (which are often referred to as "cermet" materials). The substrate 6 may include a cemented carbide material, such as a cemented tungsten carbide material, in which tungsten carbide particles are cemented together in a metallic binder material. The metallic binder material may include, for example, cobalt, nickel, iron, or alloys and mixtures thereof. Alternatively, other substrate materials may be used.

It is to be appreciated that, while the cutting element 2 shown in FIG. 1 has a generally cylindrical shape, other shapes are within the scope of the present disclosure. By way of non-limiting example, the cutting element 2 may have an elliptical, rectangular, triangular, or tombstone shape when viewed in a transverse plane. Additionally, while the cutting face 10 of the superabrasive table 4 is shown as being generally planar, the cutting face 10 may include non-planar features or may be have an entirely non-planar geometry. Furthermore, while the interface 8 between the superabrasive table 4 and the substrate 6 may be generally planar, as shown in FIG. 1, the interface 8 may also include shaped features or may have an entirely non-planar geometry, as described in more detail below.

Figure 2:
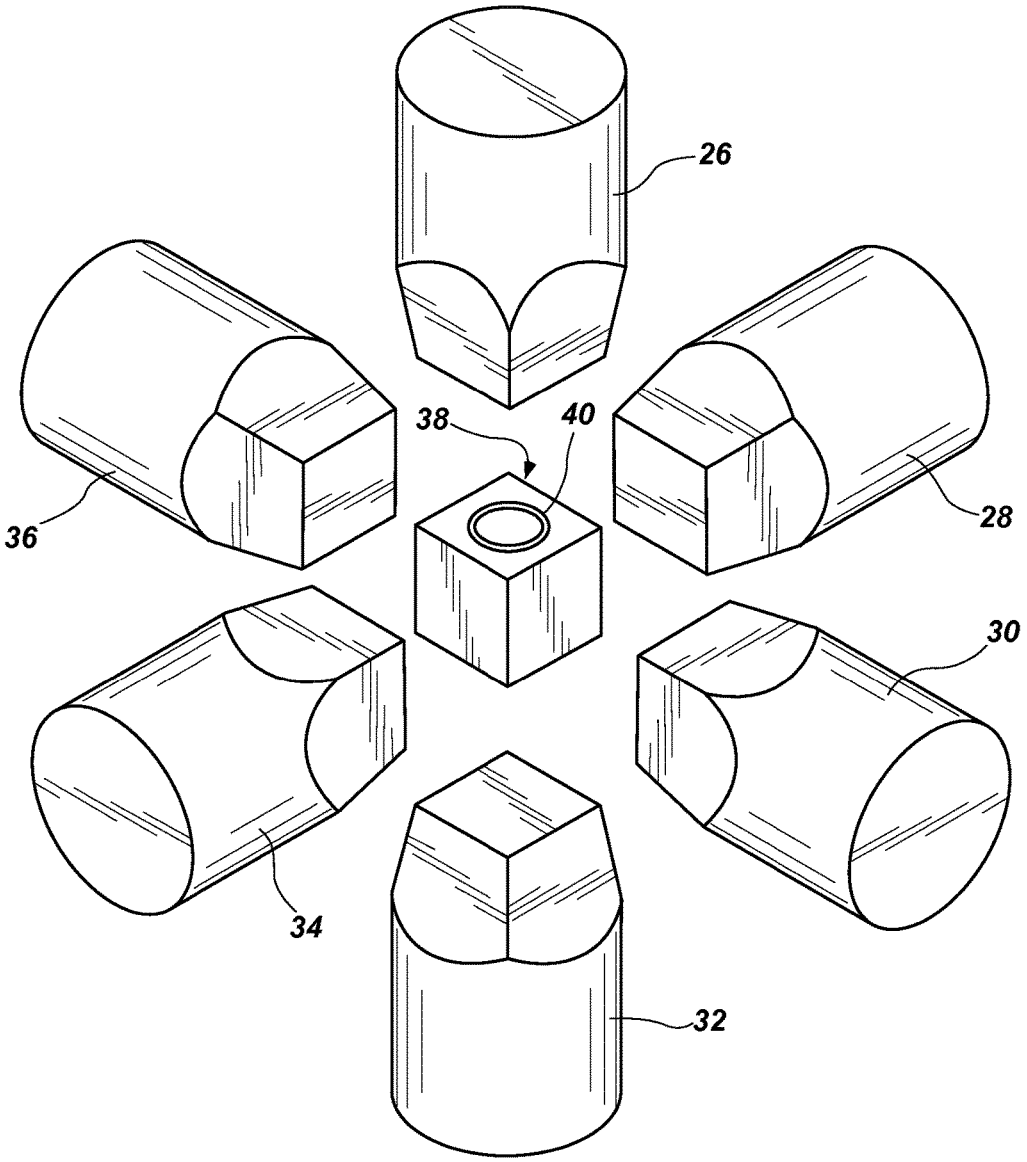
FIG. 2 illustrates a partial isometric view of anvils of a high pressure, high temperature cubic press for forming cutting elements.

FIG. 2 illustrates anvils of a cubic press converging on a cubic volume for creating an HTHP environment for forming the cutting element 2 of FIG. 1. The cubic press may include six (6) anvils 26, 28, 30, 32, 34, 36 each configured to apply pressure to a respective face of a cubic cell assembly 38 and to pass a current through a heating element (not shown) of the cell assembly 38 sufficient to generate diamond stable HTHP conditions within the cell assembly 38. The anvils 26, 28, 30, 32, 34, 36 may apply a selected pressure to the respective faces of the cell assembly 38 sufficient to apply a selected pressure between about 5 GPa and 9 GPa to contents of a canister 42 (shown in FIG. 3) located within the cell assembly 38 and carrying constituent materials of the cutting element 2. Concurrently, opposed anvils 26 and 32 may establish electrical contact with corresponding electrical contacts 40 of the cell assembly 38, and a selected electric current may be controllably passed through the electrical contacts 40 to a heating element (not shown) located within the cell assembly 38 and configured to thereby heat the contents of the canister 42 to a temperature of at least about 1300° Celsius. One example of a cubic press is more fully described in U.S. Pat. No. 8,074,566, issued Dec. 13, 2011 to Bach, the entire disclosure of which is incorporated herein by this reference.

Figure 3:
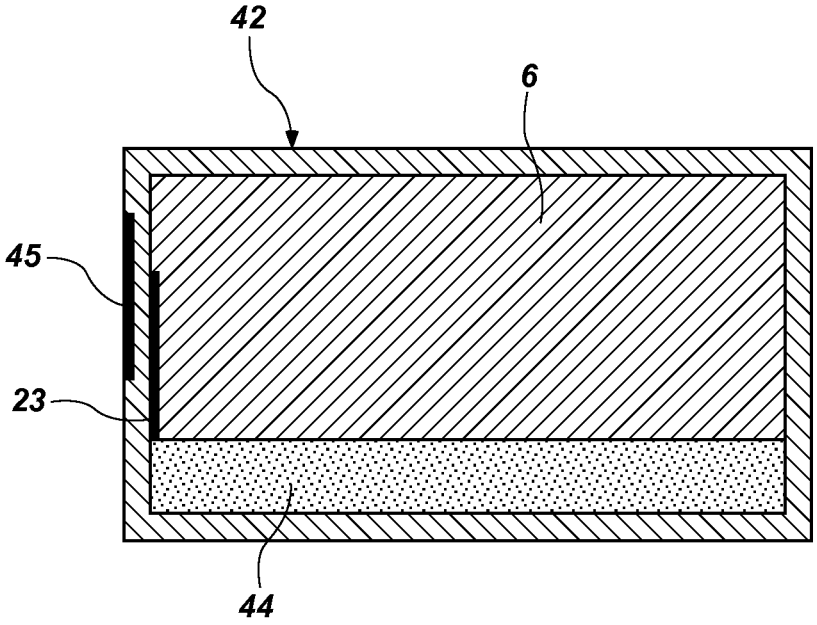
FIG. 3 illustrates a cross-section side view of a canister carrying constituent materials of a cutting element, according to an embodiment of the present disclosure.

FIG. 3 illustrates a schematic view of a canister 42 containing a plurality of superabrasive material particles 44 and a substrate 6 to be formed collectively into a cutting element, such as the cutting element 2 of FIG. 1, within the cell assembly 38 of FIG. 2. The plurality of superabrasive material particles 44 may be disposed in the canister 42 and may comprise any of the superabrasive materials previously described in relation to the superabrasive table 4. The plurality of superabrasive material particles 44 may comprise a mono-modal size distribution or a multi-modal (e.g., bi-modal, tri-modal, etc.) size distribution. The substrate 6 may, likewise, be disposed in the canister 42 and may comprise a pre-sintered part. When the superabrasive material particles 44 comprise diamond, a catalyst material (not shown) may also be provided in the canister 42 for catalyzing grain growth and interbonding among the plurality of superabrasive materials particles 44 under pressure and temperature conditions less rigorous than may otherwise be required. In some embodiments, the binder material of the substrate 6, comprising a Group VIII metal or alloy, may comprise the catalyst, the catalyst may be provided as a layer (e.g., particles, a disc, a film) between the substrate 6 and the superabrasive material particles 44, or the catalyst may comprise particles intermixed with the superabrasive material particles 44. It is to be appreciated that the canister 42 may be formed of two or more members assembled and swaged and/or welded together. The canister 42 may also carry a reference mark 45, as described in more detail below.

The cubic press provides an HTHP environment within the canister 42 in the cell assembly 38 for a duration sufficient to enable grain growth and interbonding among the plurality of superabrasive material particles 44. The plurality of superabrasive material particles 44 may be fully sintered and fully bonded to the substrate 6 during a single run of the cubic press or during multiple runs of the cubic press.

Once the plurality of superabrasive material particles 44 are fully sintered and fully bonded to the substrate 6 to form the cutting element 2, the cell assembly 38, with the canister 42 therein, may be removed from the cubic press. As the cutting element 2 cools, relative differences in the coefficients of thermal expansion of the superabrasive table 4 and the substrate 6 create residual stresses within the cutting element 2. In particular, because the substrate 6 may possess a greater coefficient of thermal expansion than the superabrasive table 4, the substrate 6 may contract to a greater extent during cooling than the superabrasive table 4, creating undesirable residual stresses in the cutting element 2, particularly at the interface 8 between the superabrasive table 4 and the substrate 6, but also at the cutting face 10. Undesirable residual stresses within the superabrasive table 4 may lead or contribute to cracking, spalling, delamination or other modes of failure of the superabrasive table 4 during use in an earth-boring operation.

The inventors have observed two (2) general categories of cracks formed in the superabrasive tables 4 of cutting elements 2 formed in a cubic press. A first type of such cracks includes a pair of hairline cracks emanating from an engaging portion of the cutting edge 12 (i.e., the portion of the cutting edge 12 of the superabrasive table 4 that engages the uncut earth formation material) and extending generally arcuately in a curved manner across the cutting face 10 in a "cat-eye" pattern. The inventors have also observed crescent-shaped cracks, termed "thumbnail" cracks, located on the cutting face 10 proximate the engaging portion of the cutting edge 12 and being concave in the direction of the engaging portion. The inventors have also observed spalls formed in the cutting face 10 of the superabrasive table 4 adjacent the engaging portion. The inventors believe that the cat-eye and thumbnail cracks are at least partially a result of the unique stress distributions imposed within the superabrasive table 4 by the orientation of the anvils 26-36 of the cubic press during the HTHP process, which stress distributions result in residual stresses that are subsequently amplified by service loads imposed on the superabrasive table 4 during use. Tensile residual stresses in the superabrasive table are particularly undesirable because polycrystalline diamond compacts (PDCs) and other superabrasive table materials are known to possess a significantly greater compressive strength than tensile strength. Accordingly, the superabrasive table of a cutting element is much more likely to fail when possessing tensile residual stresses, particularly at a region within the engaging portion, than a similarly configured superabrasive table possessing only compressive residual stresses.

The implementation of non-planar, shaped and/or irregular geometric features at the interface 8 between the superabrasive table 4 and the substrate 6, as well as non-planar, shaped and/or irregular geometric features in or on the cutting face 10 of the cutting element 2, have been known to reduce undesirable residual stresses within the cutting element 2, as more fully described in United States Patent Publication No. 2013/0306377 A1, published Nov. 21, 2013 to DiGiovanni et al., the entire disclosure of which is incorporated herein by this reference. Nevertheless, undesirable residual stresses continue to present a significant risk of failure to superabrasive tables 4 having non-planar geometries during use, particularly when the cutting element 2 is oriented on an earth-boring tool in a manner such that service loads are superimposed on undesirable residual stresses within the superabrasive table 4 in a manner maximizing net stresses within the superabrasive table 4.

Figure 4:
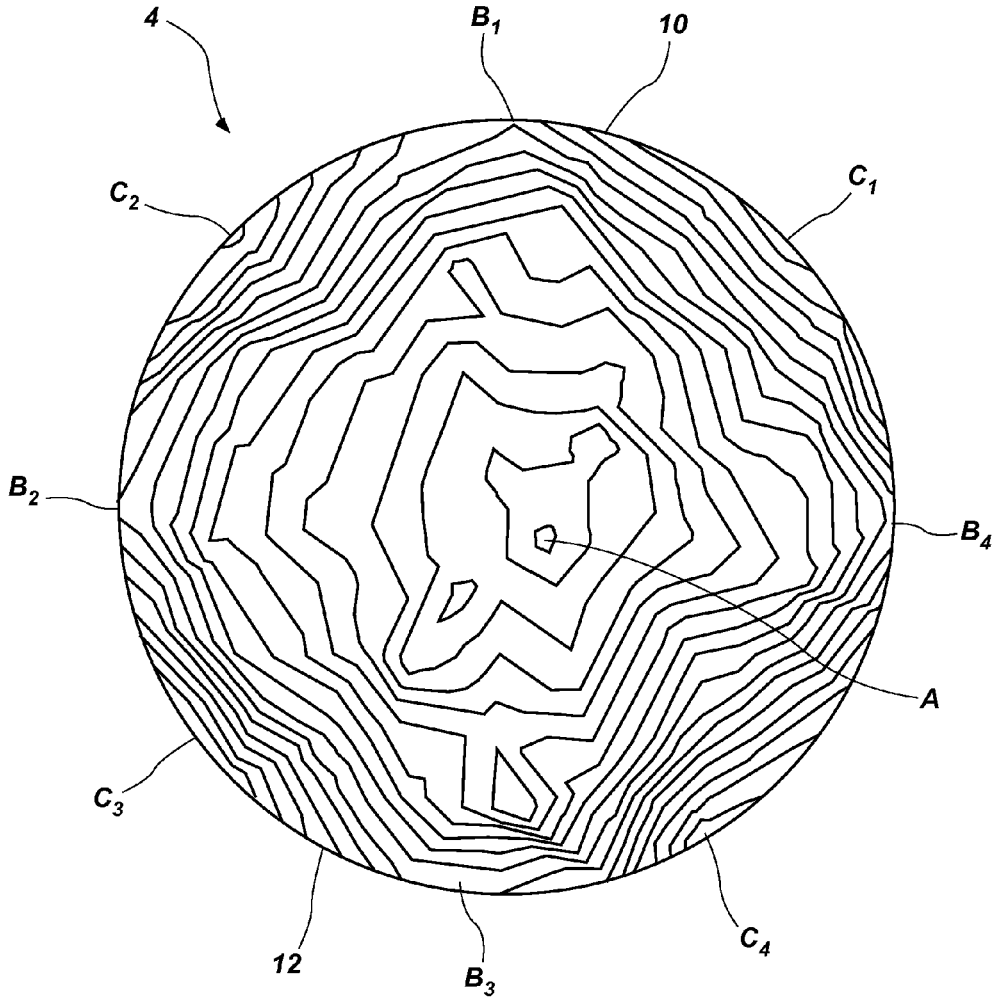
FIG. 4 illustrates a diagram of residual stresses at a cutting face of a superabrasive table, which residual stresses were obtained by a finite element analysis, according to an embodiment of the present disclosure.

FIG. 4 illustrates a schematic diagram of a stress field of in-plane residual stresses calculated or measured at the cutting face 10 of a superabrasive table, such as the superabrasive table 4 of FIG. 1, formed in a cubic press. The residual stresses were calculated or measured in a transverse plane. Such residual stresses were calculated by performing a finite element analysis (FEA) on the table of superabrasive material 4; however, other stress-measuring techniques may be used to ascertain the magnitude, extent and orientation of residual stresses within the superabrasive table, such as, by way of non-limiting example, a neutron diffraction technique, an X-ray diffraction technique, inspection of worn or damaged cutting elements, or back-grinding the substrate 6 and measuring the strain. With continued reference to FIG. 4, each contour in the diagram represents a gradient in the residual stress of the superabrasive table 4, while the areas between the contours represent specific stress ranges. In the particular cutting element 2 shown in FIG. 4, all of the calculated residual stresses at the cutting face 10 are compressive, with the stress magnitude generally decreasing (i.e., becoming less compressive) with increasing radial distance from the center of the superabrasive table 4. This general relationship is caused because the substrate 6 typically "pulls" the superabrasive table 4 longitudinally downward at the radial periphery more so than at locations radially inward as the substrate 6 contracts during cooling to a greater extent than the superabrasive table 4. This longitudinally downward pulling effect at the periphery of the superabrasive table 4 may increase with longitudinal proximity to the interface 8 between the superabrasive table 4 and the substrate 6. Thus, the compressive residual stresses at the peripheral regions of the superabrasive table 4 may decrease in magnitude (and may become tensile in some embodiments of cutting elements) with increasing longitudinal proximity to the interface 8. It is to be appreciated that, in other cutting elements, the residual stress field of the superabrasive table may vary from that shown in FIG. 4 based on a number of parameters, as described in more detail below.

With continued reference to FIG. 4, the residual stress gradients at the cutting face 10 of the superabrasive table 4 of the cutting element 2 indicate a stress field that may be broadly described as having a generally rectangular-shaped geometric pattern, particularly in the relatively lower stress regions of the field. As indicated by the stress field, the compressive residual stresses may be highest at a region A located generally proximate a center of the cutting face 10, wherein the residual compressive stress may be in a range of about 3.423 MPa to about 3.430 MPa. At outer peripheral regions $B_1$-$B_4$ of the cutting face 10 corresponding to the "corners" of the generally rectangular-shaped stress field, the compressive residual stresses may drop to within a range of about 3.337 MPa to about 3.350 MPa. However, at outer peripheral regions $C_1$-$C_4$ of the cutting face 10 located circumferentially between the corners of the generally rectangular-shaped stress field, the compressive residual stresses may be even lower, particular, within a range of about 3.297 MPa to about 3.310 MPa.

The inventors believe that the cat-eye and thumbnail cracks previously described may be prone to form when the cutting element 2 is orientated on an earth-boring tool such that one of the relatively lower compressive residual stress peripheral regions $C_1$-$C_4$ of the superabrasive table 4 occupies the engaging portion of the superabrasive table 4.

Figure 5:
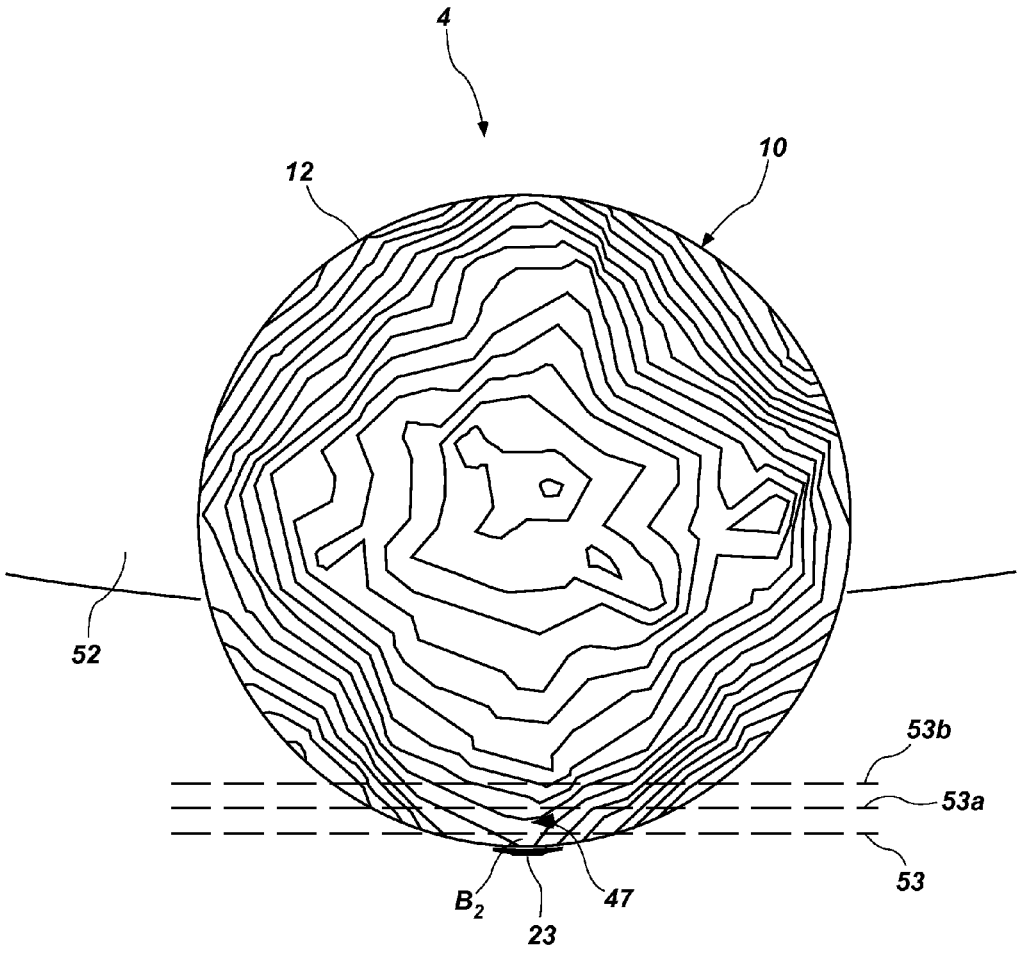
FIG. 5 illustrates the diagram of FIG. 4 superimposed on a cutting face oriented in a manner to engage uncut earth formation material with a region of the cutting face having a high compressive residual stress relative to other regions of the cutting face, according to an embodiment of the present disclosure.

The inventors have discovered that orienting the cutting element 2 on an earth-boring tool so that the relatively lower compressive residual stresses at the engaging portion are unaligned with anticipated service loads in a preferential manner may reduce the likelihood of crack formation in the superabrasive table 4 and may extend the service life of the cutting element 2. As shown in FIG. 5, the cutting element 2 may be oriented on a tool body 52 so that one of the relatively higher compressive residual stress outer peripheral regions $B_1$-$B_4$ of the cutting face 10 (i.e., at one of the corners of the generally rectangular-shaped stress field) may occupy the engaging portion, shown at portion 47, of the cutting face 10. In such a configuration, at the beginning of an earth-boring operation, uncut subterranean earth formation material, a surface of which is depicted as dashed line 53, may contact the cutting face 10 at a peripheral region of maximum compressive residual stress (i.e., minimal tensile residual stress), such as at outer peripheral region $B_2$. A reference mark 23 may be located on a lateral side surface of the cutting element 2 at a circumferential location corresponding to the circumferential location of the peripheral region $B_2$ of maximum compressive residual stress. In this manner, the circumferential location of the peripheral region $B_1$ of maximum residual stress may be readily ascertained when the cutting element 2 is affixed to the body 52 of the earth-boring tool.

With continued reference to FIG. 5, as a wear flat forms at the engaging portion 47 and progresses upward through the superabrasive table 4, the portion of the surface 53 of the uncut subterranean earth formation material contacting the cutting face 10 in a relatively higher compressive residual strength region may be maximized, as indicated by dashed lines 53*a* and 53*b*.

Figure 6:
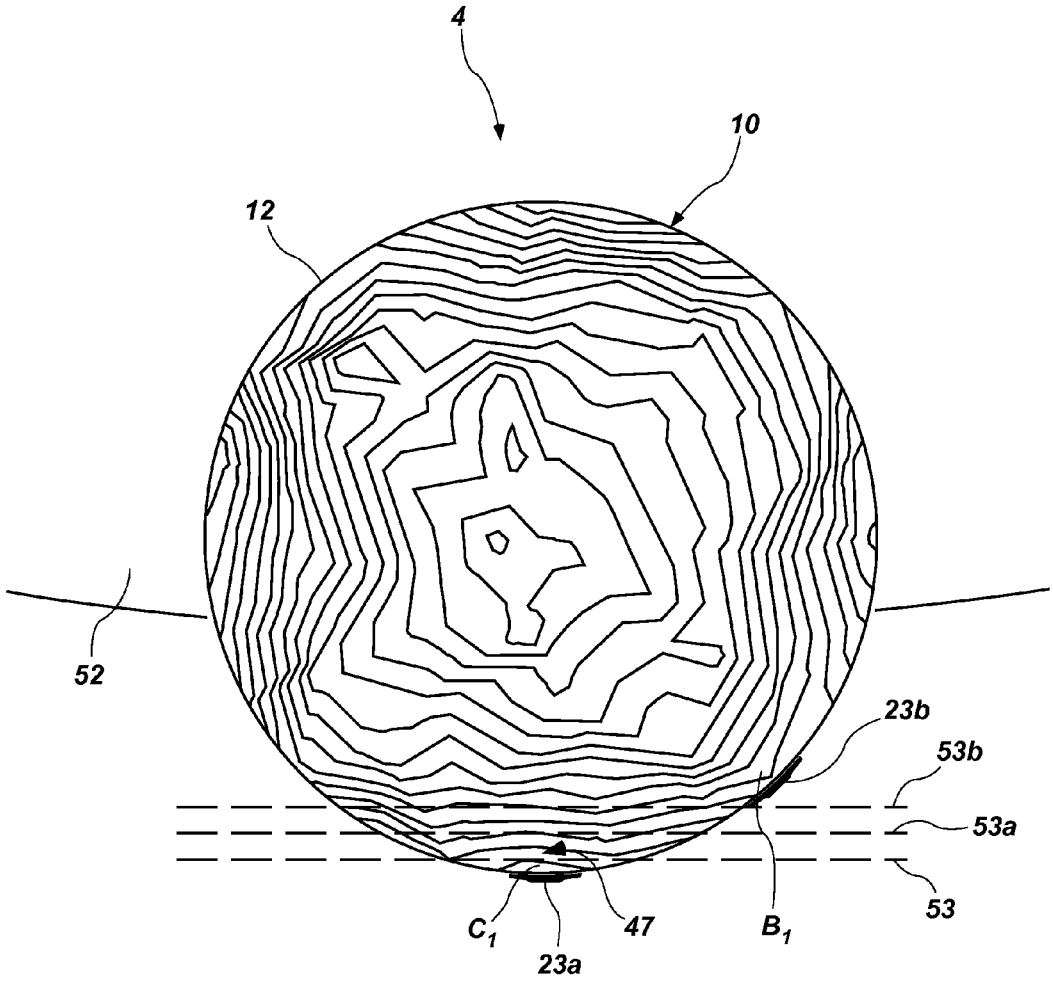
FIG. 6 illustrates the diagram of FIG. 4 superimposed on a cutting face oriented in a manner to engage uncut earth formation material with a region of the cutting face having a low compressive residual stress relative to other regions of the cutting face, according to an embodiment of the present disclosure.

In other embodiments, as shown in FIG. 6, it may be preferential to locate one of the relatively lower compressive stress corner regions $C_1$-$C_4$ of the stress field at the engaging portion 47 of the superabrasive table 4. Such an orientation may be preferential if it is anticipated that the superabrasive table 4 may not encounter significant tensile service loads at the engaging portion 47, such as when the cutting element 2 is set at a high rake angle, for example. Accordingly, the cutting element 2 may carry one or more reference marks 23*a* for indicating at least one of the relatively lower compressive stress peripheral regions $C_1$-$C_4$ of the cutting face 10 of the superabrasive table 4 and one or more additional reference marks 23*b* for indicating relatively higher compressive stress regions $B_1$-$B_4$ of the superabrasive table 4. For the generally rectangular-shaped stress pattern shown in FIGS. 4 through 6, the reference marks 23*a* and 23*b* may be circumferentially located about 45 degrees from one another about the longitudinal axis L of the cutting element 2, (see FIG. 1).

With an awareness of certain aspects of the residual stress field within the superabrasive table 4, as provided by the reference marks 23 (i.e., 23*a*, 23*b*), an operator may axially position the cutting element 2 on the tool body 52 at a calculably optimal orientation for engaging uncut subterranean earth formation material.

It is to be appreciated that a large number of other parameters may influence particular compressive and tensile service loads imposed on the superabrasive table 4 during use, which parameters may include, by way of non-limiting example, the geometry of the cutting face 10, the geometry of the interface 8 between the superabrasive table 4 and the substrate 6, the type of earth formation material engaged by the cutting element 2, the weight-on-bit (WOB) and the rate-of-penetration (ROP) of the drill bit. Accordingly, such parameters may be considered when determining an optimal axial orientation of the cutting element 2 on an earth-boring tool.

Additionally, the residual stress field within the superabrasive table 4 may be a function of a large number of parameters, a non-exclusive list of which includes: (1) the size and composition of the constituent materials of the superabrasive table 4 and the substrate 6; (2) the manner and configuration in which the constituent materials are disposed within the canister 42; (3) the particular geometry of the each of the cutting face 10, the interface 8, and the lateral side surfaces 16, 22 and the base surface 20 of the cutting element 2; (4) the size, shape, orientation and physical properties of the constituent components of the canister 42 and of the cell assembly 38; (5) the operating conditions of the press, such as the pressure and temperature applied by the anvils 26-36, the orientation of the anvils 26-36, and the duration at which the various operating conditions are maintained; and (6) the ambient temperature of the environment in which the cutting element 2 allowed to cool after removal from the press. Accordingly, it is to be appreciated that the particular generally rectangular-shaped stress field depicted in FIG. 4 represents only one of a vast amount of various potential residual stress fields at the cutting face 10 of the superabrasive table 4.

To calculate the residual stress field at the cutting face 10 of a particular cutting element 2, a finite element analysis (FEA) or other stress-calculating technique may be performed on that particular cutting face 10. However, in other embodiments, residual stress fields may be analyzed, recorded, catalogued for each cutting element 2 formed according to a particular set of the foregoing parameters. Accordingly, the reference mark 23 may be applied to the cutting element 2 at a predetermined location according to the known parameters under which the cutting element 2 was formed in a manner to readily identify the optimal axial orientation of the cutting element 2 for engaging uncut earth formation material. Stated differently, the reference mark 23 may provide an indication of a region of the superabrasive table 4 that possesses a subset of predictable residual stresses within the superabrasive table 4, which subset may include relatively higher or lower residual stresses rendering such region calculably optimal for engaging anticipated subterranean earth formation materials.

As shown in FIG. 1, a single reference mark 23 may be included on a lateral side surface 22 of the substrate 6 proximate the interface 8 between the superabrasive table 4 and the substrate 6. The reference mark 23 may indicate a region of the cutting face 10 possessing certain residual stresses. The reference mark 23 may be applied by one or more processes, including, by way of non-limiting example, painting, printing, machining, etching, polishing, grinding or any combination thereof, and may be applied manually or robotically.

Figure 7:
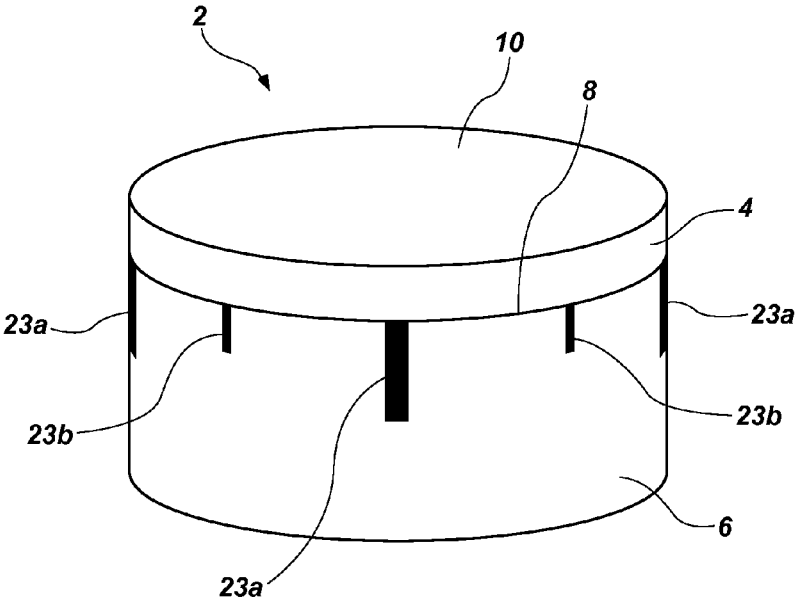
FIG. 7 illustrates a perspective view of a cutting element having a plurality of reference marks located an on external surface thereof, according to an embodiment of the present disclosure.

FIG. 7 illustrates an embodiment of the cutting element 2 having a plurality of reference marks applied thereto. In particular, the cutting element 2 may have a first set of reference marks 23*a* indicating the relatively lower residual stress regions at the cutting face 10 and a second set of reference marks 23*b* indicating the relatively higher residual stress regions at the cutting face 10. As previously described with reference to FIG. 1, the reference marks 23 may be located on the lateral side surface 22 of the substrate 6 proximate the interface 8, and may be applied by any of the methods previously described.

In other embodiments, the reference marks 23 may include protrusions extending from the lateral side surface 22 of the substrate 6, recesses formed in the lateral side surface 22 of the substrate 6, or a combination of protrusions and recesses. For example, with continued reference to FIG. 7 and FIG. 1, the reference marks 23*a*, 23*b* may optionally comprise recesses formed in the lateral side surface 22 of the substrate 6 adjacent the interface 8 prior to forming the superabrasive table 4 thereon. In further embodiments, the recesses may be filled with some of the plurality of superabrasive material particles 44 prior to sintering the plurality of superabrasive material particles 44 in the HTHP environment to form the superabrasive table 4. In such embodiments, the reference marks 23*a*, 23*b* may each comprise integral, unitary, longitudinally extending portions of the superabrasive table 4.

Figure 8:
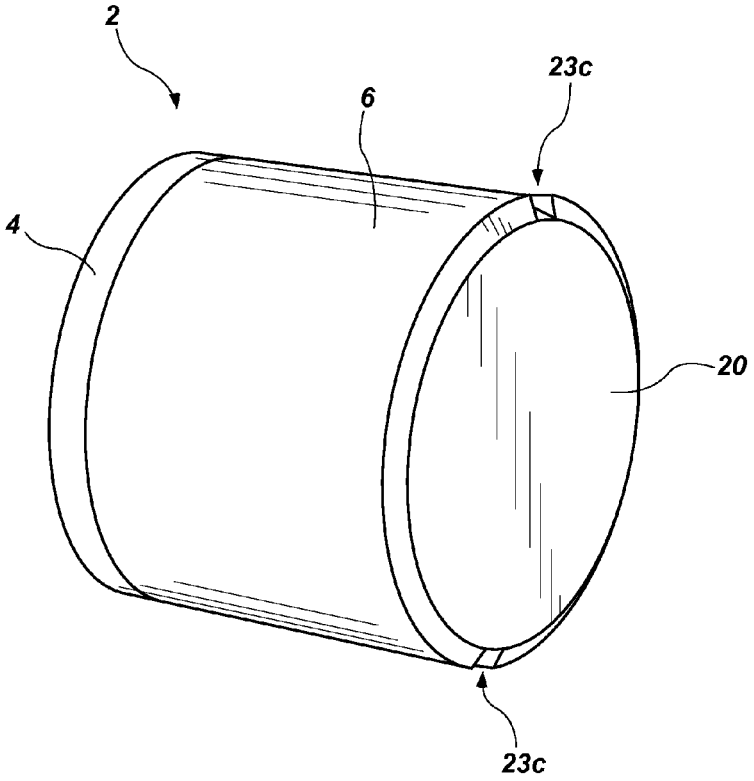
FIG. 8 illustrates a perspective view of a cutting element having a plurality of recesses formed in an external surface thereof, according to an embodiment of the present disclosure.

FIG. 8 illustrates reference marks in the form of recesses 23*c* formed in adjoining portions of the lateral side surface 22 (FIG. 1) and the base surface 20 of the substrate 6. The recesses 23*c* may be formed into the cutting element 2 by one or more mechanical processes, including, by way of non-limiting example, a cutting process, a milling process, a grinding process, a machining process, an etching process, or any combination thereof. It is to be appreciated that the recesses 23*c* may be formed in the substrate 6 prior to or after consolidating the substrate 6 and the superabrasive table 4 into a unitary cutting element 2 in an HTHP environment.

Figure 9:
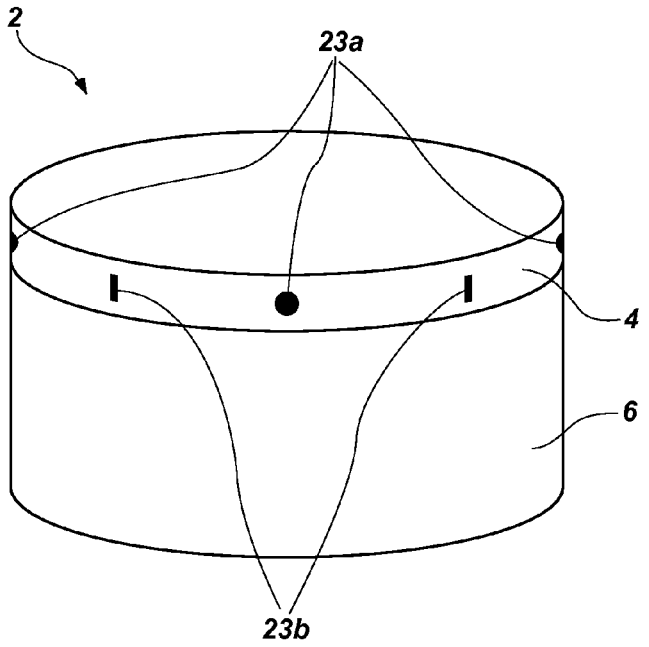
FIG. 9 illustrates a perspective view of a cutting element having a plurality of reference marks located on lateral side surface of a table of superabrasive material, according to an embodiment of the present disclosure.

In yet other embodiments, as shown in FIG. 9, one or more reference marks may be located on the lateral side surface 16 (FIG. 1) of the superabrasive table 4. For example, a first set of reference marks 23*a* may be located on the lateral side surface 16 of the superabrasive table 4 at circumferential locations corresponding to the relatively lower residual stress regions of the cutting face 10 (FIG. 1) and a second set of reference marks 23*b* may be located on the lateral side surface 16 of the superabrasive table 4 at circumferential locations corresponding to the relatively higher residual stress regions of the cutting face 10. In such embodiments, the reference marks 23*a*, 23*b* may be applied to the superabrasive table 4 after sintering the superabrasive table 4 in an HTHP environment. In further embodiments (not shown), the reference marks may be located directly on the cutting face 10 of the superabrasive table 4.

Figure 10:
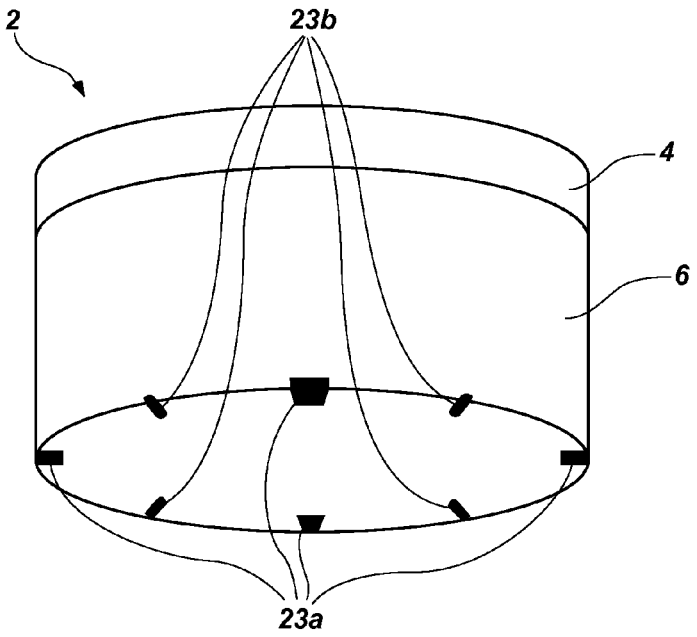
FIG. 10 illustrates a perspective view of a cutting element having a plurality of reference marks located on a base surface of a substrate of the cutting element, according to an embodiment of the present disclosure.

In further embodiments, as shown in FIG. 10, one or more reference marks 23*a*, 23*b* may be located on the base surface 20 (FIG. 1) of the substrate 6 at circumferential locations corresponding to the relatively lower and/or relatively higher residual stress regions of the superabrasive table 4. In such embodiments, a portion of the reference marks 23*a*, 23*b* may extend onto the lateral side surface 22 (FIG. 1) of the substrate 6 adjacent the base surface 20 so that the marks 23*a*, 23*b* may be visible by an operator as the cutting element 2 is affixed to an earth-boring tool, such as by brazing. It is to be appreciated that the reference marks 23 disclosed herein may be in the form of any shape, design or configuration that conveys a perceptible indication, and may be applied according to any of the processes previously described. It is also to be appreciated that the reference marks 23*a*, 23*b* may be applied to the substrate 6 prior to, during or after consolidating the substrate 6 and the superabrasive table 4 into the cutting element 2 in an HTHP environment.

Figure 11:
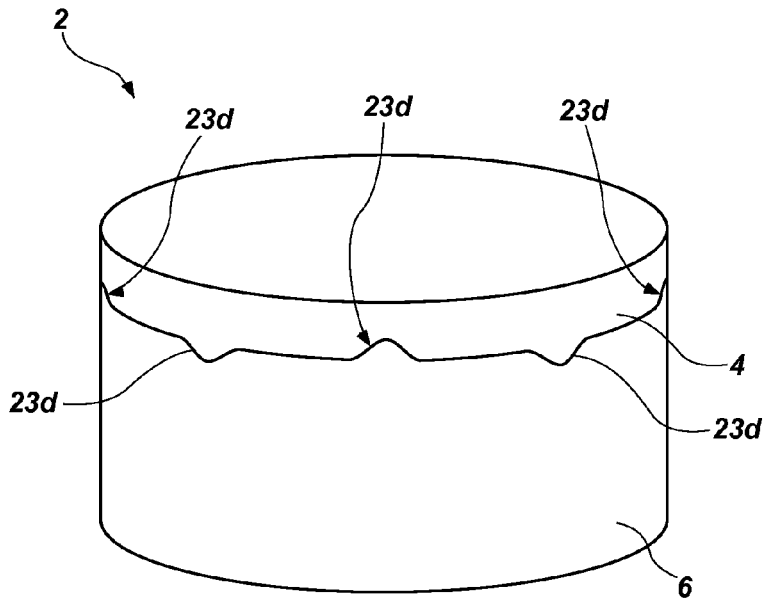
FIG. 11 illustrates a perspective view of a cutting element having reference features formed at an interface between the table of superabrasive material and the substrate, wherein the reference features have portions located at an external surface of the cutting element, according to an embodiment of the present disclosure.

In some embodiments, the reference marks 23 may be applied to the cutting element 2 prior to or effectively during the HTHP process. For example, as shown in FIG. 11, the reference marks may be in the form of one or more shaped features 23*d* of the interface 8 (FIG. 1) at least partially located at an outer peripheral region thereof so that the shaped features 23*d* are visibly perceptible on the exterior surface of the cutting element 2.

Figure 12:
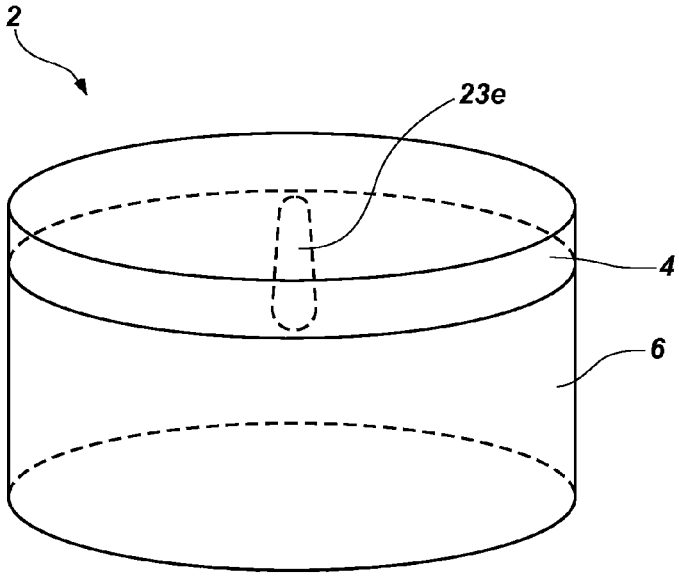
FIG. 12 illustrates a simplified partially transparent image of a cutting element having a reference feature at a radially inward portion of the interface between the table of superabrasive material and the substrate, according to an embodiment of the present disclosure.

Referring now to FIG. 12, the cutting element 2 may have a reference mark 23*e* located at a radially inward portion of the interface 8 (FIG. 1) so that the reference mark 23*e* is not visible with the naked eye on the exterior of the cutting element 2. In such embodiments, the reference mark 23*e* may comprise a feature perceptible in a specialized image or scan of the interior of the cutting element 2, such as an X-ray image, an X-ray diffraction image, a Confocal Scanning Acoustic Microscopy (CSAM) image, a thermal scan or any other non-destructive scan. The perceptible feature may include, by way of non-limiting example, a radiopaque element or dye, an element having a density different than that of the superabrasive table 4 and the substrate 6, or a shaped feature 23*e* at the interface 8 between the superabrasive table 4 and the substrate 6. It is to be appreciated that, as cutting elements are commonly formed with table-substrate interfaces having non-planar geometries, any feature of the interface 8 may form the reference mark 23*e* so long as such feature provides an indication of a material quality or property, such as residual stresses, of a region of the superabrasive table, such as residual stresses. In further embodiments, the interface geometry of a cutting element may be designed to result in a particular stress field within the superabrasive table that is predictable based on particular features of the interface geometry visible in an X-ray image obtained of the cutting element. It is to be appreciated that, in some embodiments, the image or scan of the interior of the cutting element 2 may be obtained before any portion of the superabrasive table 4 is leached.

Referring back to FIG. 3, in some embodiments, prior to disposing the canister 42 in the cell assembly 38, a primary mark 45 may be applied to the canister 42 at a location thereof predetermined by at least the orientation in which the canister 42 is to be placed in the cell assembly 38 and the orientation in which the cell assembly 38 is to be placed in the cubic press. The reference mark 23 may be applied to the substrate 6 prior to disposing the plurality of superabrasive material particles 44 and the substrate 6 in the canister 42. In this manner, an operator may align the reference mark 23 on the substrate 6 with the primary mark 45 on the canister 42 and the primary mark 45 may be utilized to orient the canister 42 in the cubic press such that, after the HTHP sintering process, the reference mark 23 on the substrate 6 corresponds to a region of the superabrasive table 4 having the relatively lower or higher residual stress, as previously described. In other embodiments, an operator may reference the primary mark 45 to apply the reference mark 23 to the cutting element 2 after removing the canister 42 from the cutting element 2 formed therein. In other embodiments, the primary mark 45 may be applied to the canister 42 after the HTHP process and after the canister 42 is removed from the cell assembly 38, which primary mark 45 may be applied to the canister 42 at a location thereof predetermined at least by the orientation in which the canister 42 was positioned in the cell assembly 38 and the orientation in which the cell assembly 38 was positioned in the cubic press.

It is to be appreciated that the foregoing embodiments and methods may be utilized to apply reference marks to cutting elements 2 formed in HTHP processes of a belt press or any other type of press capable of sintering diamond particles into a superabrasive table. It is also to be appreciated that the foregoing embodiments and methods or marking may be utilized to indicate to an operator the location of one or more regions of the cutting face 10 possessing other significant material qualities or properties.

Figure 13:
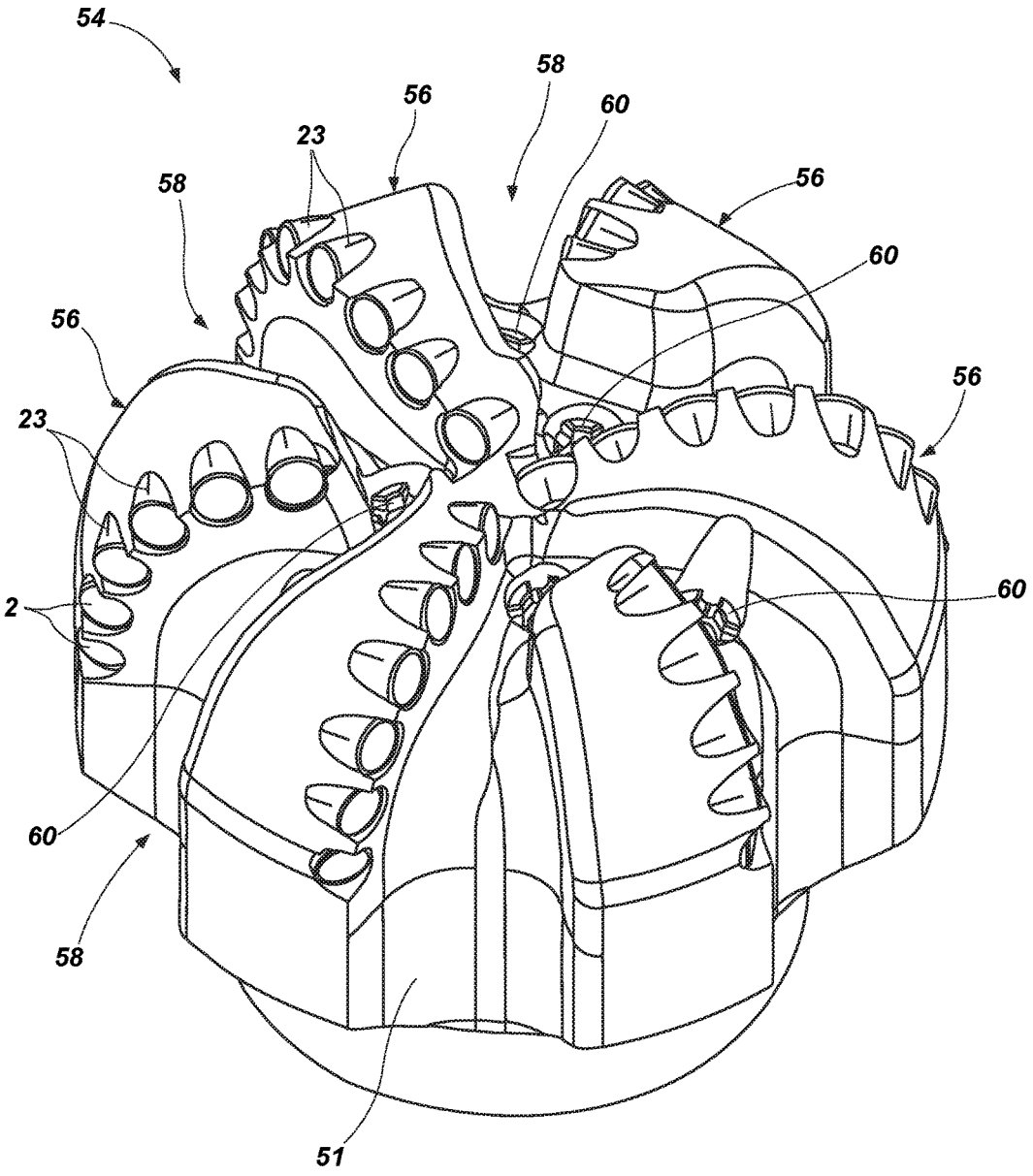
FIG. 13 illustrates a perspective view of an earth-boring drill bit having cutting elements, configured as disclosed herein and located on blades of the drill bit, according to an embodiment of the present disclosure.

FIG. 13 illustrates an earth-boring bit body 51 having cutting elements 2 attached thereto, wherein the cutting elements 2 bear reference marks 23 provided for allowing an operator to position each cutting element 2 on the bit body 51 at an optimal axial orientation determined by anticipated downhole parameters and predictable material properties or qualities of the cutting elements 2, as indicated by the reference marks 23. The bit body 51 is a fixed-cutter rotary drill bit having a bit body 51 that includes a plurality of blades 56 that project outwardly from the bit body 51 and are separated from one another by fluid courses 58. The portions of the fluid courses 58 that extend along the radial sides (the "gage" areas of the bit body 51) are often referred to in the art as "junk slots." The bit body 51 further includes a generally cylindrical internal fluid plenum, and fluid passageways (not visible) that extend through the bit body 51 to the exterior surface of the bit body 51. Nozzles 60 may be secured within the fluid passageways proximate the exterior surface of the bit body 51 for controlling the hydraulics of the bit body 51 during drilling. The cutting elements 2 are mounted to each of the blades 56. It is to be appreciated that the reference marks 23 may be utilized to axially orient the cutting elements 2 optimally depending on their location within one of the cone, nose, shoulder and gage regions of a blade 56 profile. For example, the reference marks 23 may be utilized to axially orient the cutting elements 2 in the cone and nose regions to unalign undesired residual stresses within their respective superabrasive tables with anticipated normal service loads and to axially orient the cutting elements 2 in the shoulder and gage regions to unalign undesired residual stresses within their respective superabrasive tables with anticipated tangential service loads. Additionally, reference marks 23 may be utilized to axially orient the cutting elements 2 optimally depending on the particular blade 56 to which they are attached.

The various embodiments of the cutting elements 2 and related methods previously described may include many other features not shown in the figures or described in relation thereto, as some aspects of the cutting elements 2 and the related methods may have been omitted from the text and figures for clarity and ease of understanding. Therefore, it is to be understood that the cutting elements 2 and the related methods may include many features or steps in addition to those shown in the figures and described in relation thereto. Furthermore, it is to be further understood that the cutting elements 2 and the related methods may not contain all of the features and steps herein described.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A method of forming a cutting element for an earth-boring tool, comprising:

forming a table of superabrasive material in an HTHP environment and concurrently bonding a table of superabrasive material to an adjacent substrate to form a cutting element;

removing the cutting element from the HTHP environment;

ascertaining predictable residual stresses within the table of superabrasive material; and marking the cutting element with at least one mark, the at least one mark providing indication of a region of the table of superabrasive material having a maximum or minimum residual stress therein.

2. The method of claim 1, wherein the region is a peripheral region of a cutting face of the table of superabrasive material.

3. The method of claim 1, wherein the region of the table of superabrasive material is calculably preferential for engaging uncut subterranean formation material.

4. The method of claim 1, wherein the region of the table of superabrasive material possesses a subset of the predictable residual stresses, the subset of the predictable residual stresses having lower predictable residual tensile stresses than predictable residual tensile stresses outside the region.

5. The method of claim 1, wherein ascertaining predictable residual stresses within the table of superabrasive material comprises performing a finite element analysis on at least a portion of the table of superabrasive material.

6. The method of claim 1, wherein ascertaining predictable residual stresses within the table of superabrasive material comprises correlating the table of superabrasive material with a reference residual stress field derived from at least one other table of superabrasive material.

7. The method of claim 1, wherein marking the cutting element with at least one mark comprises forming one or more of at least one reference recess and at least one reference protrusion on an external surface of the cutting element.

8. The method of claim 1, wherein marking the cutting element with at least one mark comprises one or more of painting, printing, machining and etching the at least one mark on an external surface of the cutting element.

9. The method of claim 1, wherein marking the cutting element with at least one mark comprises one or more of painting, printing, machining and etching the at least one mark on an external surface of the substrate.

10. The method of claim 1, wherein marking a portion of the cutting element with at least one mark comprises forming, in the HTHP environment, at least one feature at an interface between the table of superabrasive material and the substrate.

11. The method of claim 10, wherein the at least one feature comprises a portion of the cutting element located at an external surface of the cutting element in a manner to be visibly distinguishable.

12. The method of claim 10, wherein the at least one feature is distinguishable in one or more of an X-ray image, an X-ray diffraction image, a Confocal Scanning Acoustic Microscopy image and a thermal scan of the cutting element.

13. The method of claim 1, further comprising, prior to marking a portion of the cutting element with at least one mark, marking a container in which the table of superabrasive material and the substrate are disposed in the HTHP environment with at least one primary mark, the at least one primary mark corresponding to and identifying at least one location on the cutting element for marking with the at least one mark.

14. The method of claim 1, further comprising creating the HTHP environment in a cubic press.

15. A method of forming an earth-boring tool, comprising:

obtaining a formed cutting element carrying at least one mark, the at least one mark configured to enable the cutting element to be oriented on the earth-boring tool in a primary orientation, wherein, at the primary orientation, residual stresses within a table of superabrasive material will be preferentially unaligned with anticipated service load stresses during use in an earth-boring operation;

positioning the cutting element in the primary orientation relative to a face of the earth-boring tool; and affixing the cutting element to the face of the earth-boring tool in the primary orientation.

16. The method of claim 15, wherein the at least one mark comprises one or more of a recess and a protrusion on an external surface of the cutting element.

17. The method of claim 15, wherein the at least one mark is one or more of painted, printed, machined and etched on an external surface of the cutting element.

18. The method of claim 17, wherein the at least one mark is located on a lateral side surface of the cutting element at a location proximate an interface between a table of superabrasive material and a substrate.

19. The method of claim 15, further comprising acquiring an X-ray image of the cutting element illustrating the at least one mark.

20. The method of claim 15, wherein the cutting element was formed in a cubic press.

* * * * *